United States Patent [19]

Thomas

[11] 4,078,661

[45] Mar. 14, 1978

[54] PILL DISPENSER DEVICE

[75] Inventor: Michael D. Thomas, Arab, Ala.

[73] Assignee: Ryder International Corporation, Schaumburg, Ill.

[21] Appl. No.: 752,672

[22] Filed: Dec. 20, 1976

[51] Int. Cl.[2] ..... B65D 85/56

[52] U.S. Cl. ..... 206/533; 206/534

[58] Field of Search ..... 221/24, 5, 69, 82, 83, 221/86, 89, 91; 116/121; 206/52 B, 534, 538, 539, 533

[56] References Cited

U.S. PATENT DOCUMENTS

| | | | |
|---|---|---|---|
| 3,557,747 | 1/1971 | Rigney et al. | 221/86 |
| 3,800,940 | 4/1974 | Thomas | 206/534 |

FOREIGN PATENT DOCUMENTS

| | | | |
|---|---|---|---|
| 207,751 | 2/1960 | Germany | 221/82 |

*Primary Examiner*—Robert B. Reeves
*Assistant Examiner*—H. Grant Skaggs
*Attorney, Agent, or Firm*—Olson, Trexler, Wolters, Bushnell & Fosse, Ltd.

[57] ABSTRACT

A pill dispenser device is disclosed comprising a circular base provided with a plurality of circumferentially spaced compartments defined therein. A knurled actuator ring is provided having the same circumference as the base which is affixed to the base outside of the compartments therein and is rotatable within limits defined by an opening in the ring which cooperates with a stop in the base. A cover is provided rotatably attached to the base having a single pill exit opening formed thereon. The cover is also provided with a plurality of ratchet teeth which cooperates with the knurled ring and the base for advancing the pill exit into alignment with successive compartments to allow the removal of individual pills therefrom.

11 Claims, 6 Drawing Figures

PILL DISPENSER DEVICE

BACKGROUND OF THE INVENTION

The present invention relates generally to pill dispensers, and more particularly to a pill dispensing device incorporating drive or actuator means for allowing the removal of only a single pill per actuation from the pill dispensing device.

In recent years, there has developed a growing need to provide means for establishing a closely controlled regimen in the dispensing of medications and drugs. In order to properly monitor the progress of a patient being treated with a given medication, it is necessary to establish that the patient has in fact been taking the medication as directed. There are now available on the market, to this end, numerous mechanical dispensing devices as well as many types of non-mechanical packaging techniques for the manual removal or separation of pills therefrom.

Many medications in pill or tablet form as, for example, oral contraceptives, must be taken on a regular basis over a certain period of time, and a given number of pills must be taken during this time period for the medication to be effective. Therefore, it is desirable to provide a dispenser for such medications which includes means for indexing the dispenser to correspond to the times at which the medication is to be taken. Also, it is desirable to provide an indexed dispenser which requires some positive actuation on the part of the user to dispense each pill individually at the proper time for taking it, along with a positive indication of how many pills have been taken, and how many remain to be taken.

It is an object of the present invention, therefore, to provide a new and improved pill dispenser.

A more specific object of the invention is to provide a new and improved pill dispenser which has indexing means for identifying individual pills according to the times at which they are to be taken.

Another object of the invention is to provide a pill dispenser in accordance with the foregoing objects which further includes means requiring positive actuation by the user to release each pill individually at the proper time for taking the pill.

Another object of the invention is to provide a dispenser in accordance with the foregoing objects which provides an indication of how many pills have been taken and how many pills remain to be taken.

Another object of this invention is to provide a pill dispenser in accordance with the foregoing objects which comprises relatively few and inexpensive parts, making its manufacture relatively simple and economical and enabling it to be discarded when empty.

SUMMARY OF THE INVENTION

Briefly, the pill dispensing device according to the present invention comprises three basic parts; a base member, an actuator ring member and a top or cover member. All three members are of generally circular shape. The circular base portion includes a central raised portion or circular hub and a plurality of compartments formed in a annular recess which is disposed circumferentially of the central hub portion. The compartments or pockets are of equal size depending upon the type of pills to be dispensed, and are defined by a plurality of partitions or relatively narrow walls extending radially across the annular recess. The central portion or hub may also be provided with indicia such as letters or numbers indicating the days of the week, and disposed around a circumference thereof corresponding to each of the compartments.

A ring or actuator member rests in a channel provided therefore around the outer circumference of the base and is rotatable with respect to the base. The ring member is provided with a notch or opening in the circumference thereof which cooperates with a stop member in the channel to define the limits or degree of rotation of the ring with respect to the base.

A transparent cover member is rotatably supported by the hub and encloses the top portion of the compartments in the base. The cover is provided with a single opening of the same size as a single compartment to allow the exit of an individual pill therethrough. The cover is also provided with ratchet teeth disposed aroung the circumference at the bottom portion thereof, to cooperate with the ring and base to allow the opening in the cover to be successively advanced to alignment with each of the compartments. The ring and base are each provided with one or more ratchet teeth or ramps suitably aligned to cooperate with the ratchet teeth of the cover in advancing the cover opening in response to alternate clockwise and counter-clockwise rotation of the ring between the limits of rotation.

DETAILED DESCRIPTION OF THE INVENTION

Figure 1:
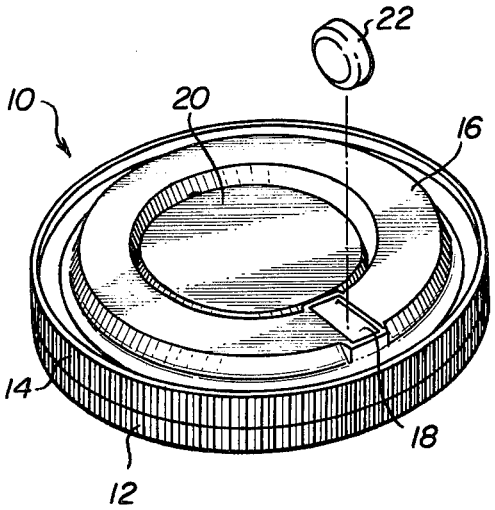
FIG. 1 is a perspective view of the pill dispenser of the present invention.
Figure 2:
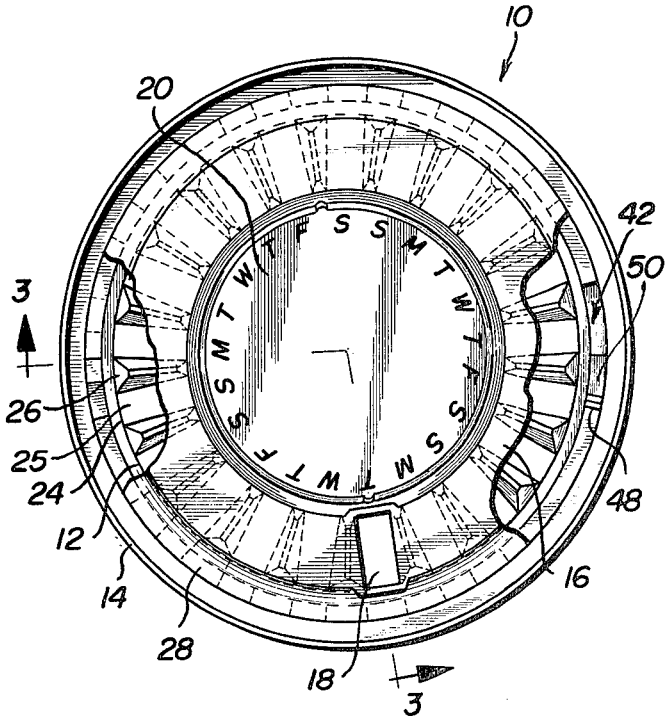
FIG. 2 is a top or plain view of the pill dispenser with portions of the cover broken away.
Figure 3:
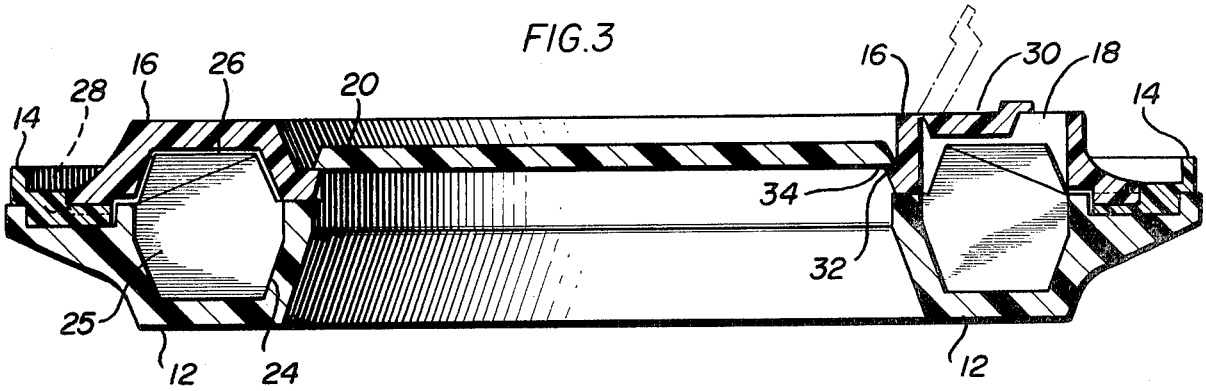
FIG. 3 is an enlarged elevational view taken generally along line 3—3 of FIG. 2.
Figure 4:
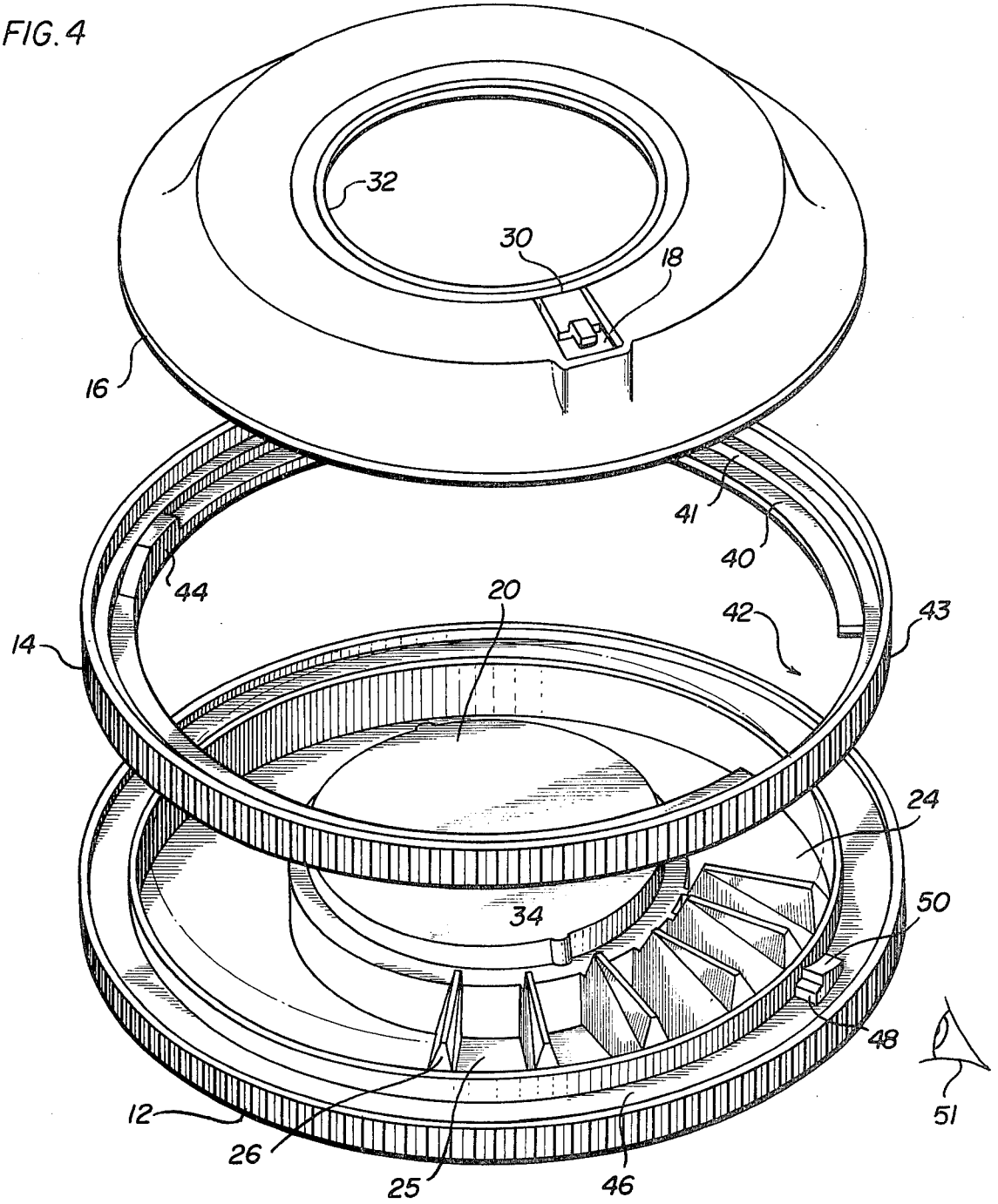
FIG. 4 is an exploded perspective view of the pill dispenser.

FIGS. 1, 2 and 3 illustrate the pill dispenser 10, which comprises a base 12, and actuator ring 14 and a cover 16, all of which are substantially circular in shape. The cover 16 is provided with a single opening 18 of suitable dimensions to allow the passage therethrough of a pill 22. The opening 18 may also be provided with a removable lid or door 30, best seen in FIGS. 3 and 6. The base 12 has a raised central portion or hub 20 and a recessed portion 24 formed circumferentially around the hub 20. Individual compartments 25 of equal size are formed in recessed portion 24 by a plurality of equally spaced walls or partitions 26 extending radially outward from the hub 20 across the recessed portion 24, as best seen in FIG. 2 and FIG. 4. The hub 20 is also provided with indicating indicia 22 printed around the circumference thereof which are illustrated in FIG. 2 as letters corresponding to the days of the week. Each of the indicators 22 is placed so as to correspond to an individual compartment 25. The cover 16 is also provided with a series of evenly spaced ratchet teeth 28 disposed around the bottom outer circumference thereof. The hub member 20 also includes a series of ears or tabs 34 which cooperate with a lip 32 formed on the cover 16 rotatably to attach the cover 16 to the base 12, as best seen in FIGS. 3 and 4.

Referring now specifically to FIG. 4 means by which the base 12, actuator ring 14 and top 16 are fitted together and cooperate are more clearly illustrated. The base 12 is provided with a circumferential channel or recess 46 disposed outside of the compartmented recess 24, for receiving the ring 14. The ring is provided with a shoulder 42 and a lip 40 by which it is rotatably fitted into the channel 46 of the base 12. Lip 40 has an arcuate, elongate notch or opening 42 formed therein to cooperate with a stop member or ramp-like projection 48 formed in the channel 46. The engagement of the stop member 48 in said notch 48 serves to limit the degree of rotation of the ring 14 with respect to the base 12, for a purpose to be explained.

The outer surface of the ring is provided with a knurled edge 43 to allow manual bidirectional rotation of the ring within the limits above described, the outer diameter of the ring 14 being at least equal to the outer diameter of the base 12. The outer diameter of the top or cover portion 16 is slightly less than the inner diameter of the shoulder 41 of ring 14, to permit the top 16 to be fitted directly upon the lip 40 of ring 14, and also to provide for unrestricted freedom of rotation. The lip 40 includes a second ramp-like projection in the form of a single ratchet tooth 44, which will cooperate with the ratchet teeth 28 of the top or cover 16 to produce rotation thereof with respect to the base 12, as explained hereafter. The stop member 48 of base 12 in addition to defining the limits of movement of ring 14 also includes a ramp or ratchet tooth surface portion 50. The surface portion 50 is sloped in the same arcuate direction as tooth 44 and cooperates with the ratchet teeth 28 of the top or cover 16 through the opening 42 in the ring 14 to control the rotation of the top 16 with respect to the base 12, also in a manner to be explained.

Figure 5:
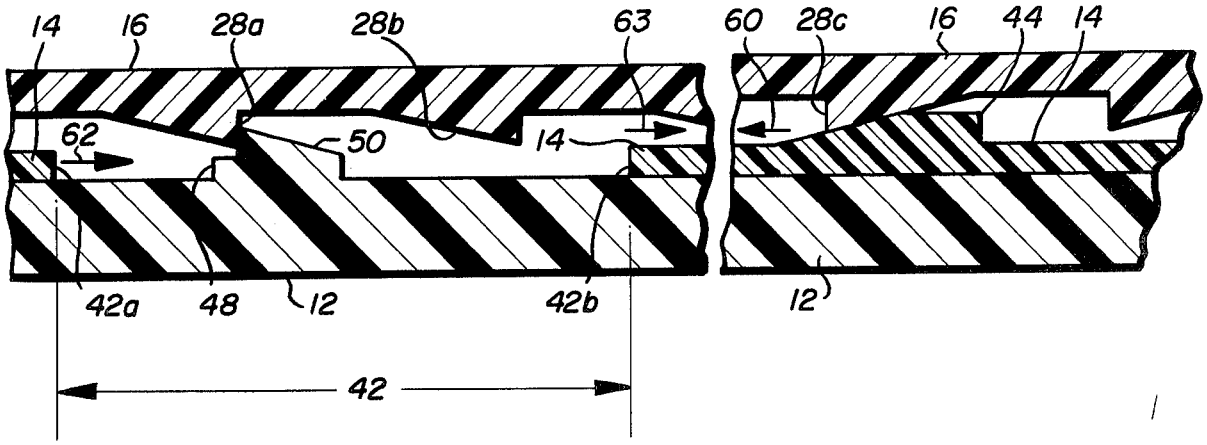
FIGS. 5 and 6 are detailed views of the advancing mechanism of the pill dispenser illustrating the operation thereof, each view being in two segments, with the right hand portion as viewed illustrating the engagement of the ratchet or cam means on the ring with the cover, the left hand portion the function of the combination stop and ramp on the base relative to said ring and cover.
Figure 6:
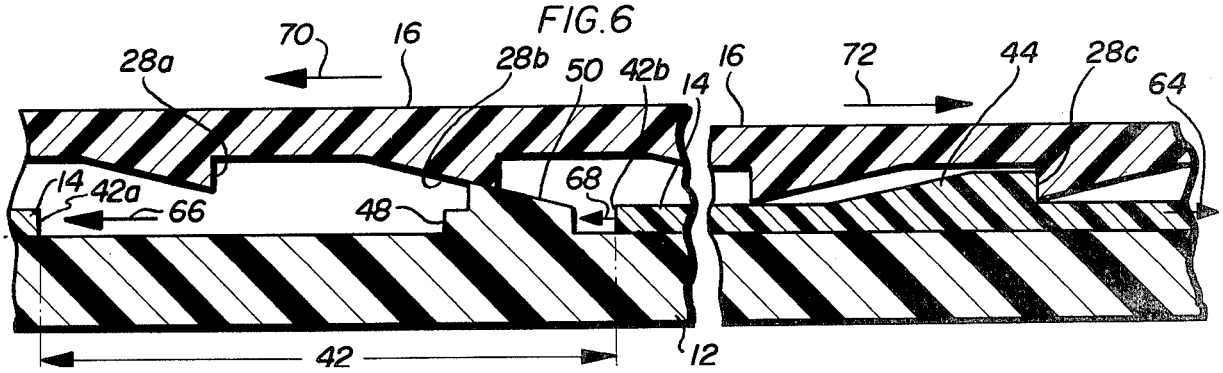

Referring to FIG. 5, there is shown the relative relationship of the cover 16, ring 14 and base 12 are shown, at the location of the ratchet tooth 44 (right hand portion as viewed) and at the diametrically opposed location of the combination stop and ramp member 48–50 (left hand portion as viewed). This view represents an intermediate or initial condition, that is preparatory to indexing. Further, it must be kept in mind that the respective portions of FIG. 5 are at diametrically opposed locations, such that movement of the ring 14 in the direction indicated by arrow 60 in said right hand portion, will result in movement of ring 14 as indicated by arrows 62 and 63 at the location of the stop member 48, viz., left hand portion. Referring specifically to FIG. 5, the manipulation of the actuator ring 14 preparatory to rotating the top member for positioning the opening 18 above a selected compartment 25 of the base 12, is shown. In FIG. 5 as well as in FIG. 6 the base 12 is held stationary by the user and only the ring 14 is rotated. In FIG. 5 and FIG. 6, the left hand portions represent a sectional view of a side elevation about the member 48, while the right hand portions represent a sectional view of a side elevation taken about the member 44 on the opposite side of the dispenser from member 50, viewed as indicated by the eye 51 in FIG. 4. Referring to the left hand portion of FIG. 5, the ring 14 is rotated in the direction shown by arrows 62 and 63 to its limit of rotation in that direction as defined by the stop member 48 on the base 12. It can be seen that the top or cover member 16 is prevented from rotating in unison with ring 14 by its ratchet tooth 28*a* which is in contact with a vertical surface on the ramp portion 50 formed on the stop member 48. Referring to the right hand side of FIG. 5, the same direction of rotation of the ring, viewed as indicated by the eye 51 in FIG. 4, is shown by arrow 60. A ramp or ratchet tooth 44 formed on the ring 14 will have its ramped or sloped surface in contact with a corresponding surface of a ratchet tooth 28*c* of the top or cover member 16. The resilience of the plastic material which forms each member and the stationary position of the cover 16 as defined by tooth 28*a* in contact with ramp 50 as already described, allows the ratchet tooth 44 to pass or slide under the corresponding tooth 28*c* to attain the relative position shown in the right hand portion of FIG. 6.

Referring now to FIG. 6, in the right hand portion thereof, the vertical wall of tooth or ramp 44 of the ring 14 is now in engaged, driving contact with the vertical wall of ratchet tooth 28*c* of the cover 16. Accordingly, as the ring 14 is manually rotated in the opposite direction from that as shown in FIG. 5, as indicated by arrow 64, the cover 16 will be carried along with the ring 14 as shown by arrow 72. Referring now to the left hand side of FIG. 6, the same direction of rotation of ring 14 and cover 16 are indicated by arrows 66 and 68 and arrow 70, respectively. In this regard, as cover 16 moves with ring 14, ratchet tooth 28*b* on said cover slide relative to the ramp 50.

The limits of the rotation of ring 14 are defined by stop 48 and slot 42. Slot 42, ratchet teeth 28, 44 and 50 are all sized or dimensional, so that movement as shown in FIG. 5 to bring the vertical surface of tooth 28*c* into engagement with the corresponding surface of tooth 44 will cause an edge 42*a* of said slot to engage the stop member 48, preventing furthur movement of the ring 14 relative to the base in the direction 60, 62, 63. Correspondingly, when ring 14 is moved in the opposite direction to drive the cover 16, the other edge 42*b* of the slot will abut the stop member 48. Thus, it can be seen that given ratchet teeth 28, 44 and 50 of a given size, the length of the slot 42 determines the degree of movement of the cover 16. Accordingly, said slot 42 is sized so that each instance of clockwise and counter-clockwise rotation of the ring 14 will produce movement of the cover which is sufficient to move the opening 18 precisely into alignment with the next pill compartment. When this occurs, the next successive tooth member 28*b* of top member 16 assumes the same placement as ratchet tooth 28*a* of FIG. 5.

In operation of the pill dispenser 10, the user has only to grasp the knurled outer portion of the actuator ring 14 and rotate it in a first direction to its stop and then in the opposite direction until it again reaches its stop to rotate the opening 18 in the cover 16 from one compartment 25 to the next adjacent compartment. In this manner, pills may be dispensed singly in consecutive order according to the markings 22 corresponding to the successive compartments 25. This will dispense one pill at each successive period, whether it be at a given hour, on a given day of the week, or a given date of the month. Since the lid 16 is also made of a transparent material, a glance at the dispenser will immediately tell what pills have been dispensed at what periods, what pill is to be taken next and at what time, and how many pills remain to be taken.

While a specific embodiment of the present invention has been shown and described herein, it is obvious that specific details may be changed somewhat without departing from the spirit and scope of the appended claims.

The invention is claimed as follows:

1. A pill dispenser comprising: a substantially circular base portion having a plurality of circumferentially disposed compartments formed therein for receiving pills and a recess formed therein concentric with said compartments, an actuator ring rotatably fitted in said recess, a cover portion rotatably attached to said base and seated upon said ring, said cover having an opening therein of substantially the same size as one of said compartments, said opening located adjacent to said compartments to permit selectively the exit of pills therefrom, and means on said base, said actuator ring and said cover for rotating said ring and said cover with respect to said base to sequentially align said opening with successive compartments to allow removal of pills from individual selected compartments while keeping the remaining compartments covered.

2. The pill dispenser of claim 1 wherein said means comprises a series of ratchet teeth formed in said cover portion and a first ramp on said ring to cooperate therewith for rotating the cover portion in a direction determined by the alignment of said teeth and said first ramp.

3. The pill dispenser of claim 2 wherein said rotating means further includes an arcuate opening in said ring and a stop member disposed in said recess to define limits of rotation of said ring between a first and a second position.

4. The pill dispenser of claim 3 wherein said stop member further includes a second ramp projecting through said arcuate opening to cooperate with said ratchet teeth for limiting the rotation of the cover to said direction defined by said alignment of said ratchet teeth and said first ramp.

5. The pill dispenser of claim 4 wherein said first and second positions are circumferentially spaced by a dimension equal to the increment of spacing of said compartments.

6. The pill dispenser of claim 5 wherein each of said ratchet teeth on said cover have a circumferential dimension equal to the increment of spacing of said compartments.

7. A pill dispenser comprising a substantially circular base having a central hub portion and a first recess formed therein concentric with said hub, means dividing said first recess into a plurality of compartments of equal size to receive pills and a second recess concentric with said first recess, a cover for said compartments rotatably supported on said hub and having a single pill exit opening therein, means for rotating said cover on said base to sequentially align said opening with individual seccessive compartments to allow removal of pills therefrom, said rotating means including an actuator ring, said actuator ring being rotatably mounted in said second recess, and means for guiding said actuator ring between a first and a second position, said positions being circumferentially spaced by a dimension equal to the increment of spacing of said compartments.

8. The pill dispenser of claim 7 wherein said rotating means further includes a series of ratchet teeth formed in said cover portion and a first ramp on said ring to cooperate therewith for rotating said cover in a direction determined by the alignment of said teeth in said first ramp.

9. The pill dispenser of claim 7 wherein said guiding means includes an arcuate opening in said ring and a stop surface in said recess to define limits of rotation of said ring between said first and second positions.

10. The pill dispenser of claim 9 wherein said stop surface further includes a second ramp projecting through said arcuate opening to cooperate with said ratchet teeth for limiting the rotation of the cover to said direction defined by said alignment of said ratchet teeth and said first ramp.

11. The pill dispenser of claim 7 wherein said hub includes indicator means aligned with the respective compartments to identify the individual pills and the periods when each is to be used.

* * * * *